US008979209B2

(12) United States Patent
Wade et al.

(10) Patent No.: US 8,979,209 B2
(45) Date of Patent: Mar. 17, 2015

(54) STABILIZATION SYSTEM FOR A MINING MACHINE

(75) Inventors: Colin Anthony Wade, Johannesburg (ZA); Jacobus Ignatius Jonker, Vanderbijlpark (ZA)

(73) Assignee: Joy MM Delaware, Inc., Wilmington, DE (US)

( * ) Notice: Subject to any disclaimer, the term of this patent is extended or adjusted under 35 U.S.C. 154(b) by 151 days.

(21) Appl. No.: 13/566,150

(22) Filed: Aug. 3, 2012

(65) Prior Publication Data

US 2013/0033085 A1 Feb. 7, 2013

Related U.S. Application Data

(60) Provisional application No. 61/514,542, filed on Aug. 3, 2011, provisional application No. 61/514,543, filed on Aug. 3, 2011, provisional application No. 61/514,566, filed on Aug. 3, 2011.

(51) Int. Cl.

| | |
|---|---|
| ***E21C 35/00*** | (2006.01) |
| ***E21C 35/08*** | (2006.01) |
| ***E21C 25/16*** | (2006.01) |
| ***E21C 31/12*** | (2006.01) |
| *E21C 35/24* | (2006.01) |
| *E21D 9/10* | (2006.01) |
| *E21C 35/10* | (2006.01) |

(52) U.S. Cl.

CPC ..... *E21C 35/08* (2013.01); *E21C 25/16* (2013.01); *E21C 31/12* (2013.01); *E21C 35/24* (2013.01); *E21D 9/108* (2013.01); *E21C 35/10* (2013.01)

USPC ..... 299/1.3; 299/33; 299/31

(58) Field of Classification Search

USPC ..... 299/1.3, 1.05, 31, 33

See application file for complete search history.

(56) References Cited

U.S. PATENT DOCUMENTS

| | | | | |
|---|---|---|---|---|
| 2,608,823 A | | 9/1952 | Silver et al. | |
| 2,699,328 A | | 1/1955 | Alspaugh et al. | |
| 2,801,095 A | | 7/1957 | Ball | |
| 3,625,483 A | * | 12/1971 | Stoner | 254/423 |
| 4,045,088 A | | 8/1977 | Bechem | |

(Continued)

FOREIGN PATENT DOCUMENTS

| | | |
|---|---|---|
| CN | 201805340 | 4/2011 |
| EP | 0217782 | 4/1987 |

(Continued)

OTHER PUBLICATIONS

Mining Mirror, "Continuous Hard Rock Mining a Reality?," magazine article (Apr. 2003), 4 pages.

(Continued)

*Primary Examiner* — John Kreck

(74) *Attorney, Agent, or Firm* — Michael Best & Friedrich LLP

(57) ABSTRACT

A mining machine including a frame, a cutting head moveably coupled to the frame and pivotable about an axis that is substantially perpendicular to a first mine surface, and a first actuator for stabilizing the frame relative to the first mine surface. The first actuator is coupled to the frame and includes a first end extendable in a first direction to engage the first mine surface. The extension of the first actuator is automatically controlled based on measurements of at least one indicator of the force between the first actuator and the first mine surface.

8 Claims, 18 Drawing Sheets

(56) References Cited

U.S. PATENT DOCUMENTS

| | | | | |
|---|---|---|---|---|
| 4,088,371 | A | 5/1978 | Lebegue et al. | |
| 4,228,508 | A | 10/1980 | Benthaus | |
| 4,548,442 | A | 10/1985 | Sugden et al. | |
| 4,669,560 | A | 6/1987 | Wilcox, Jr. et al. | |
| 5,073,067 | A * | 12/1991 | Elliott-Moore | 405/302 |
| 5,161,857 | A | 11/1992 | Mayercheck et al. | |
| 5,234,257 | A | 8/1993 | Sugden et al. | |
| 5,310,249 | A | 5/1994 | Sugden et al. | |
| 6,857,705 | B2 | 2/2005 | Hainsworth et al. | |
| 7,407,189 | B2 * | 8/2008 | Hiebert et al. | 280/766.1 |
| 7,695,071 | B2 | 4/2010 | Jackson et al. | |
| 8,157,330 | B2 | 4/2012 | Niederriter | |
| 2002/0060450 | A1 * | 5/2002 | Ahlers et al. | 280/764.1 |
| 2006/0082079 | A1 * | 4/2006 | Eichhorn et al. | 280/6.155 |
| 2006/0158017 | A1 | 7/2006 | McKenzie | |
| 2009/0212216 | A1 | 8/2009 | Hargrave et al. | |
| 2011/0163590 | A1 | 7/2011 | Mozar et al. | |
| 2011/0198914 | A1 | 8/2011 | Hartwig et al. | |
| 2012/0068523 | A1 | 3/2012 | Bowles | |

FOREIGN PATENT DOCUMENTS

| | | |
|---|---|---|
| GB | 624347 | 6/1949 |
| GB | 1093118 | 11/1967 |
| GB | 1273334 | 5/1972 |
| GB | 2005753 | 10/1978 |
| JP | 3208986 | 9/1991 |
| WO | 9118184 | 11/1991 |
| WO | 2005049965 | 6/2005 |
| WO | 2009103306 | 8/2009 |

OTHER PUBLICATIONS

Voest-Alpine, "Alpine Reef Miner ARM 1100," brochure, (downloaded in Mar. 2006) 2 pages.

Wirth, "Navara Water Supply," brochure, (downloaded May 7, 2010), 2 pages.

PCTUS2012049563 International Search Report and Written Opinion mailed Oct. 16, 2012, 18 pages.

* cited by examiner

STABILIZATION SYSTEM FOR A MINING MACHINE

RELATED APPLICATIONS

This application claims the benefit of prior-filed, U.S. Provisional Application No. 61/514,542, filed Aug. 3, 2011, U.S. Provisional Patent Application No. 61/514,543, filed Aug. 3, 2011, and U.S. Provisional Patent Application No. 61/514,566, filed Aug. 3, 2011, the entire contents of all of which are hereby incorporated by reference. The present application also incorporates by reference the entire contents of PCT Patent Application No. PCT/US2012/049532, filed Aug. 3, 2012 and titled "AUTOMATED OPERATIONS OF A MINING MACHINE" and U.S. Non-Provisional patent application Ser. No. 13/566,462, filed Aug. 3, 2012 and titled "MATERIAL HANDLING SYSTEM FOR MINING MACHINE".

BACKGROUND

The present invention relates to mining equipment, and particularly to continuous mining machines.

Traditionally, excavation of hard rock in the mining and construction industries, has taken one of either two forms, explosive excavation or rolling edge disc cutter excavation. Explosive mining entails drilling a pattern of holes of relatively small diameter into the rock being excavated, and loading those holes with explosives. The explosives are then detonated in a sequence designed to fragment the required volume of rock for subsequent removal by suitable loading and transport equipment. However, the relatively unpredictable size distribution of the rock product formed complicates downstream processing.

Mechanical fragmentation of rock eliminates the use of explosives; however, rolling edge cutters require the application of very large forces to crush and fragment the rock under excavation. Conventional underground mining operations may cause the mine roof (also called the hanging wall) and mine walls to become unstable. In order to prevent the walls from collapsing as the mining machine bores deeper into a mineral seam, hydraulic cylinders are used to support the mine walls. To support the hanging wall, the hydraulic cylinders often must exert forces of over 40 tons against the hanging wall. This force causes the hydraulic support to bore into the hanging wall, which weakens the hanging wall and increases the risk of falling rocks.

SUMMARY

One embodiment of the invention provides a mining machine including a frame, a cutting head moveably coupled to the frame and pivotable about an axis that is substantially perpendicular to a first mine surface, and a first actuator for stabilizing the frame relative to the first mine surface. The first actuator is coupled to the frame and includes a first end extendable in a first direction to engage the first mine surface. The extension of the first actuator is automatically controlled based on measurements of at least one indicator of the force between the first actuator and the first mine surface.

Another embodiment of the invention provides a method for stabilizing a mining machine relative to a mine surface. The method includes extending at least one actuator toward a mine surface until at least one indicator of the force between the actuator and the mine surface reaches a predetermined value, retracting the at least one actuator for a predetermined amount of time, and extending the at least one actuator for the predetermined amount of time plus an additional amount of time.

Yet another embodiment of the invention provides a method for stabilizing a mining machine relative to a first mine surface and a second mine surface. The method includes extending a first actuator toward the first mine surface until at least one indicator of the force between the first actuator and the first mine surface reaches a predetermined value, retracting the first actuator by a first predetermined distance, extending the first actuator by the first predetermined distance plus an offset distance, extending a second actuator toward the second mine surface until at least one indicator of the force between the second actuator and the second mine surface reaches a predetermined value, retracting the second actuator by a second predetermined distance, and extending the second actuator by the second predetermined distance plus an offset distance.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or hydraulic connections or couplings, whether direct or indirect. Also, electronic communications and notifications may be performed using any known means including direct connections, wireless connections, etc.

Figure 1:
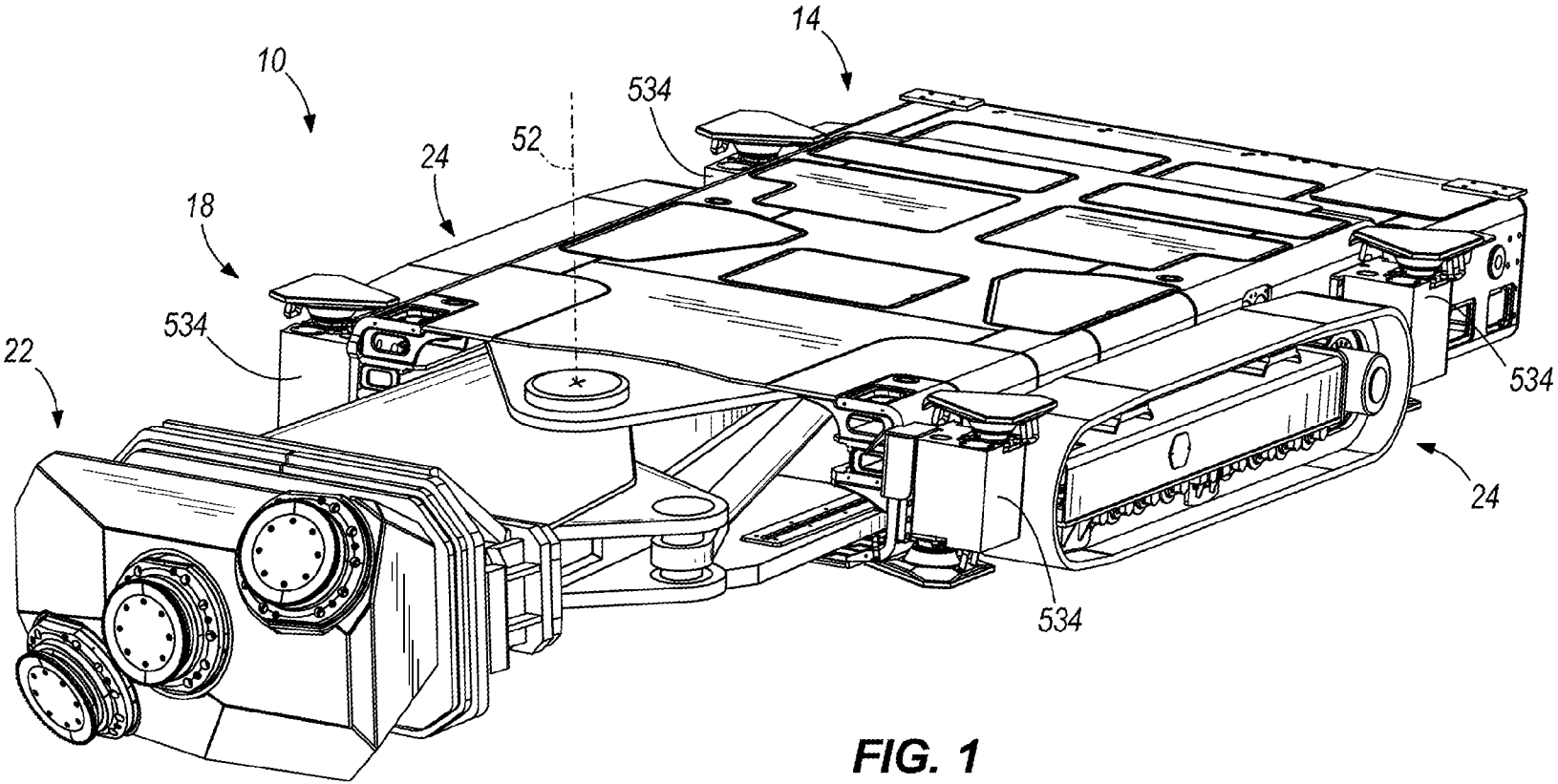
FIG. 1 is a perspective view of a mining machine.
Figure 2:
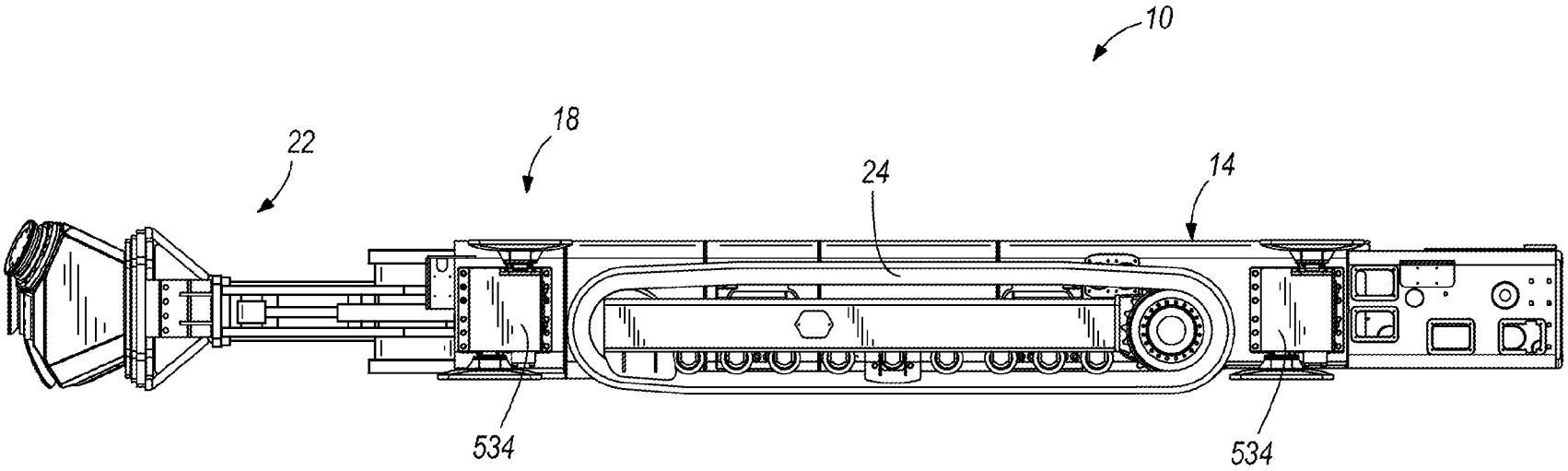
FIG. 2 is a side view of the mining machine of FIG. 1.

FIGS. 1 and 2 show a continuous mining machine 10 including a frame 14, a stabilization system 18, a cutting mechanism 22 coupled to the frame 14, and a pair of tracks 24 coupled to the frame 14, for moving the machine 10. Before describing the stabilization system 18, the mining machine 10 and cutting mechanism 22 will be described in detail.

Figure 3:
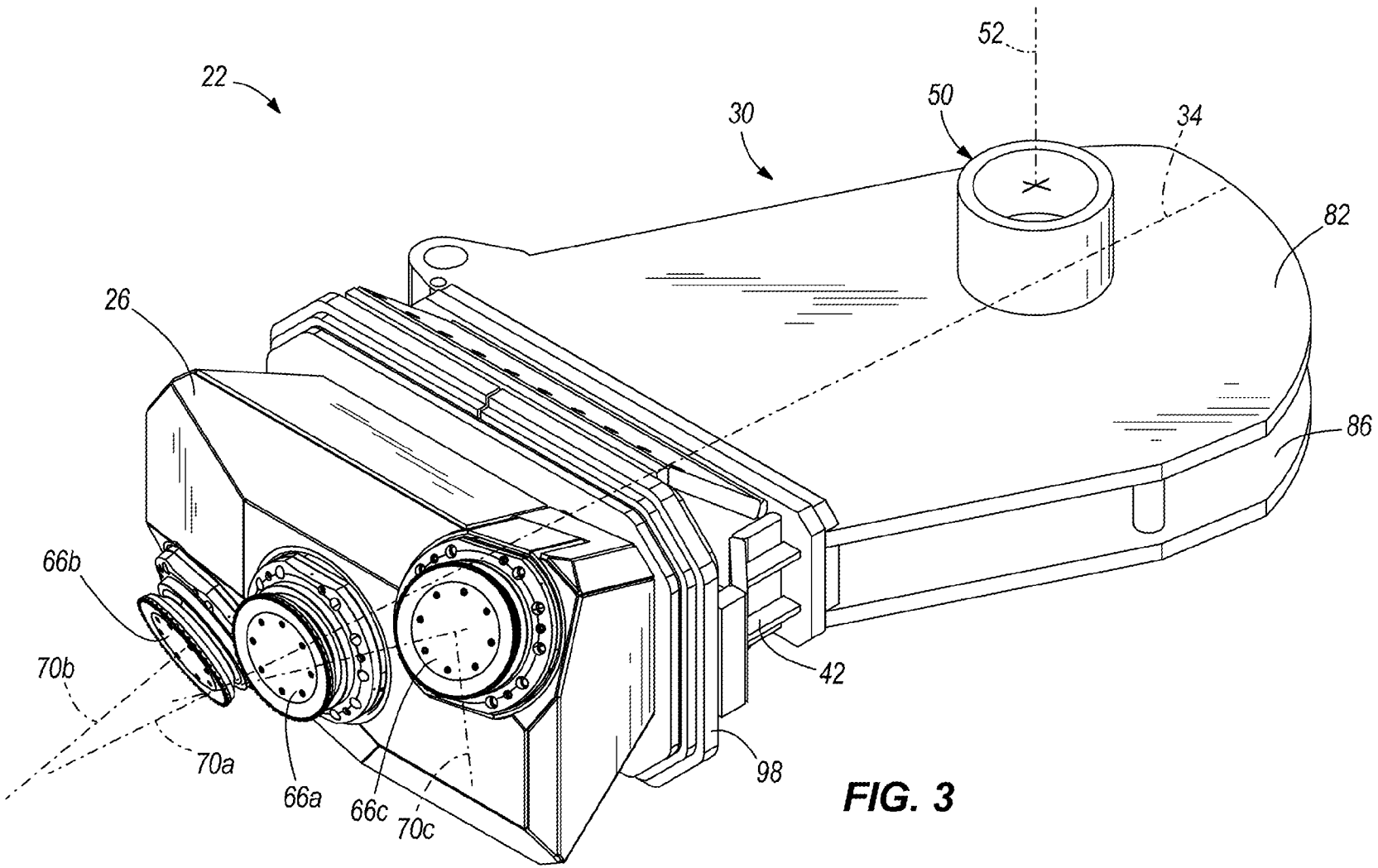
FIG. 3 is a perspective view of a cutting mechanism.
Figure 4:
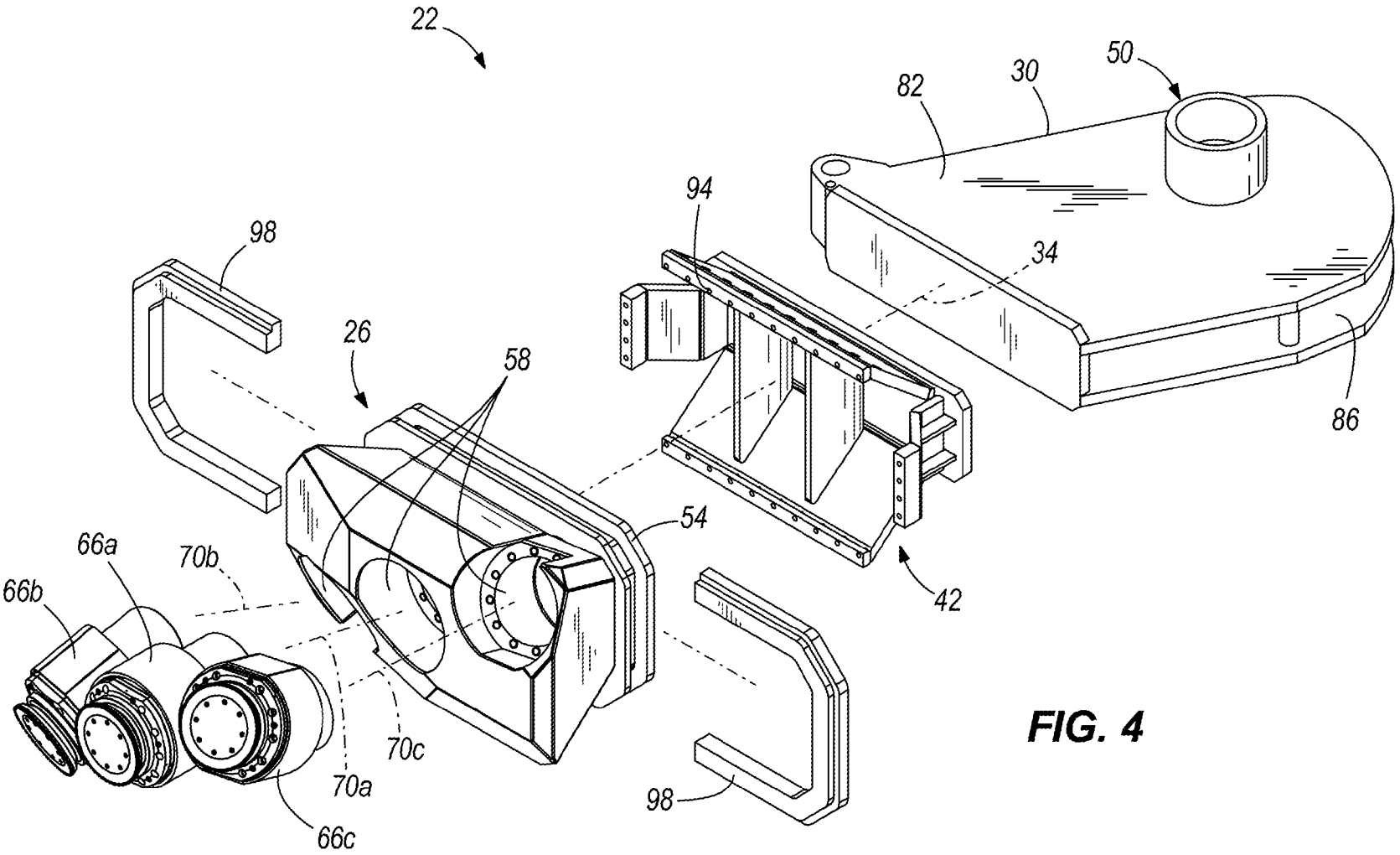
FIG. 4 is an exploded perspective view of the cutting mechanism of FIG. 3.

As shown in FIGS. 3 and 4, the cutting mechanism 22 includes a cutter head 26, an arm 30 defining a longitudinal axis 34, a bracket 42 for attaching the cutter head 26 to the arm 30, and a pivot assembly 50 coupled to the mining machine 10 and permitting the arm 30 to be pivoted about an axis 52 (FIG. 1) substantially perpendicular to a floor or surface on which the machine 10 is supported. Stated another way, the arm 30 pivots in a substantially horizontal direction. The cutter head includes a flange 54 and three openings 58 (FIG. 4), each of which releasably receives a disc cutter assembly 66. The disc cutter assemblies 66 are spaced apart from one another and oriented along separate axes. Each disc cutter assembly 66 defines a longitudinal axis of rotation 70, and the disc cutter assemblies 66 are spaced apart from one another and mounted at an angle such that the axes of rotation 70 are not parallel and do not intersect. For instance, in the embodiment shown in FIG. 3, the axis 70*a* of the center disc cutter assembly 66*a* is substantially coaxial with the longitudinal axis 34 of the arm 30. The axis 70*b* of the lower disc cutter assembly 66*b* is at an angle to the axis 70*a* of the center disc cutter 66*a*. The axis 70*c* of the upper disc cutter assembly 66*c* is at an angle to the axes 70*a*, 70*b* of the center disc cutter assembly 66*a* and the lower disc cutter assembly 66*b*. This arrangement of the disc cutter assemblies 66 produces even cuts when the cutter head 26 engages the mine wall. Further embodiments may include fewer or more cutting disc assemblies 66 arranged in various positions.

Figure 5:
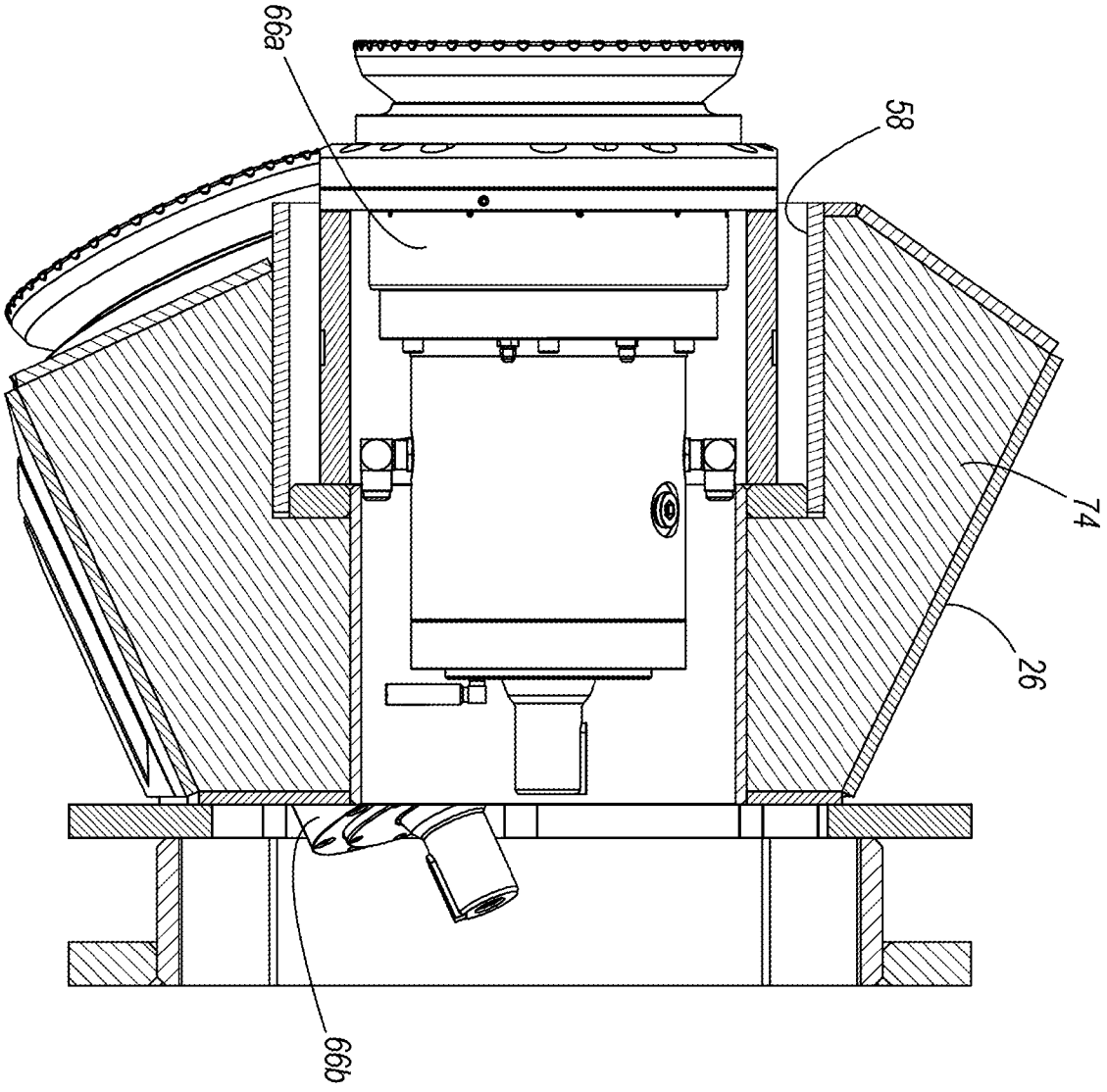
FIG. 5 is a cross-sectional view of a cutter head of the cutting mechanism of FIG. 3.

As shown in FIG. 5, the cutter head 26 also includes an absorption mass 74, in the form of a heavy material, such as lead, located in an interior volume of the cutter head 26 surrounding the three openings 58. By having the three eccentrically driven disc cutter assemblies 66 share a common heavy weight, less overall weight is necessary and permits a lighter and more compact design. In one embodiment, approximately 6 tons is shared among the three disc cutter assemblies 66. The mounting arrangement is configured to react to the approximate average forces applied by each disc cutter assembly 66, while peak cutting forces are absorbed by the absorption mass 74, rather than being absorbed by the arm 30 (FIG. 3) or other support structure. The mass of each disc cutter assembly 66 is relatively much smaller than the absorption mass 74.

In the embodiment shown in FIG. 4, the arm 30 includes a top portion 82 and a bottom portion 86. The bracket 42 includes a flange 94. The bracket 42 is secured to the arm 30 by any suitable fashion, such as welding. The bracket 42 is attached to the cutter head 26 by U-shaped channels 98. Each channel 98 receives the cutter head flange 54 and the bracket flange 94 to secure the cutter head 26 to the bracket 42. A resilient sleeve (not shown) is placed between the cutter head 26 and the bracket 42 to isolate cutter head vibrations from the arm 30.

The disc cutter assemblies 66 are driven to move in an eccentric manner. This is accomplished, for instance, by driving the disc cutter assemblies 66 using a drive shaft (not shown) having a first portion defining a first axis of rotation and a second portion defining a second axis of rotation that is radially offset from the first axis of rotation. The magnitude of eccentric movement is proportional to the amount of radial offset between the axis of rotation of each portion of the shaft. In one embodiment, the amount of offset is a few millimeters, and the disc cutter assembly 66 is driven eccentrically through a relatively small amplitude at a high frequency, such as approximately 3000 RPM.

The eccentric movement of the disc cutter assemblies 66 creates a jackhammer-like action against the mineral to be mined, causing tensile failure of the rock so that chips of rock are displaced from the rock surface. The force required to produce tensile failure in the rock is an order of magnitude less than that required by conventional rolling edge disc cutters to remove the same amount of rock. The action of the disc cutter assembly 66 against the under face is similar to that of a chisel in developing tensile stresses in a brittle material, such as rock, which is caused effectively to fail in tension. In another embodiment, the disc cutter 66 could also nutate such that the axis of rotation moves in a sinusoidal manner as the disc cutter 66 oscillates. This could be accomplished by making the axis about which the disc cutter drive shaft rotates angularly offset from a disc cutter housing.

The mining machine 10 is operated by advancing the arm 30 toward the material to be mined a first incremental distance, pivoting the arm 30 to cut the material, and then advancing the arm 30 toward the material to be mined a second incremental distance. During operation, the lower disc cutter assembly 66*b* is the first to contact the mineral to be mined when the arm 30 is pivoted in a first direction (clockwise as viewed from the top of the arm 30 in FIG. 3) about the pivot assembly 50. This results in the lower disc cutter assembly 66*b* dislodging material that falls away from the mine wall. As the center disc cutter assembly 66*a* contacts the mineral to be mined, the space below the center disc cutter assembly 66*a* has been opened by the lower disc cutter assembly 66*b*, so the material dislodged by the center disc cutter assembly 66*a* falls away from the mine wall. Likewise, as the upper disc cutter assembly 66*c* engages the material, the space below the upper disc cutter assembly 66*c* is open, and the material dislodged by upper disc cutter assembly 66*c* falls to the floor. Since the leading disc cutter is in the lower most position, the material dislodged by leading disc cutters is not re-crushed by trailing disc cutter, reducing wear on the disc cutters. In addition, the disc cutter assemblies 66 are positioned so that each disc cutter 66 cuts equal depths into the material to be mined. This prevents unevenness in the mineral to be mined that could obstruct the progress of the mining machine 10.

The stabilization system 18 may be used in combination with the continuous mining machine 10 described above, or may be used in combination with a mining machine as described in U.S. Pat. No. 7,934,776, filed Aug. 31, 2007, the entire contents of which are incorporated herein by reference. The stabilization system 18 provides added support against rock fall, and also insures that the cutting mechanism 22 cuts on a level plane with respect to the mine floor.

Referring again to FIGS. 1 and 2, the stabilization system 18 includes at least one stabilizer 534. In the illustrated embodiment, the stabilization system 18 includes four stabilizers 534, with one stabilizer 534 positioned at each of the four corners of the machine 10. In other embodiments, the machine 10 may include fewer or more than four stabilizers 534 and may be arranged in positions other than the four corners of the machine 10.

Figure 6:
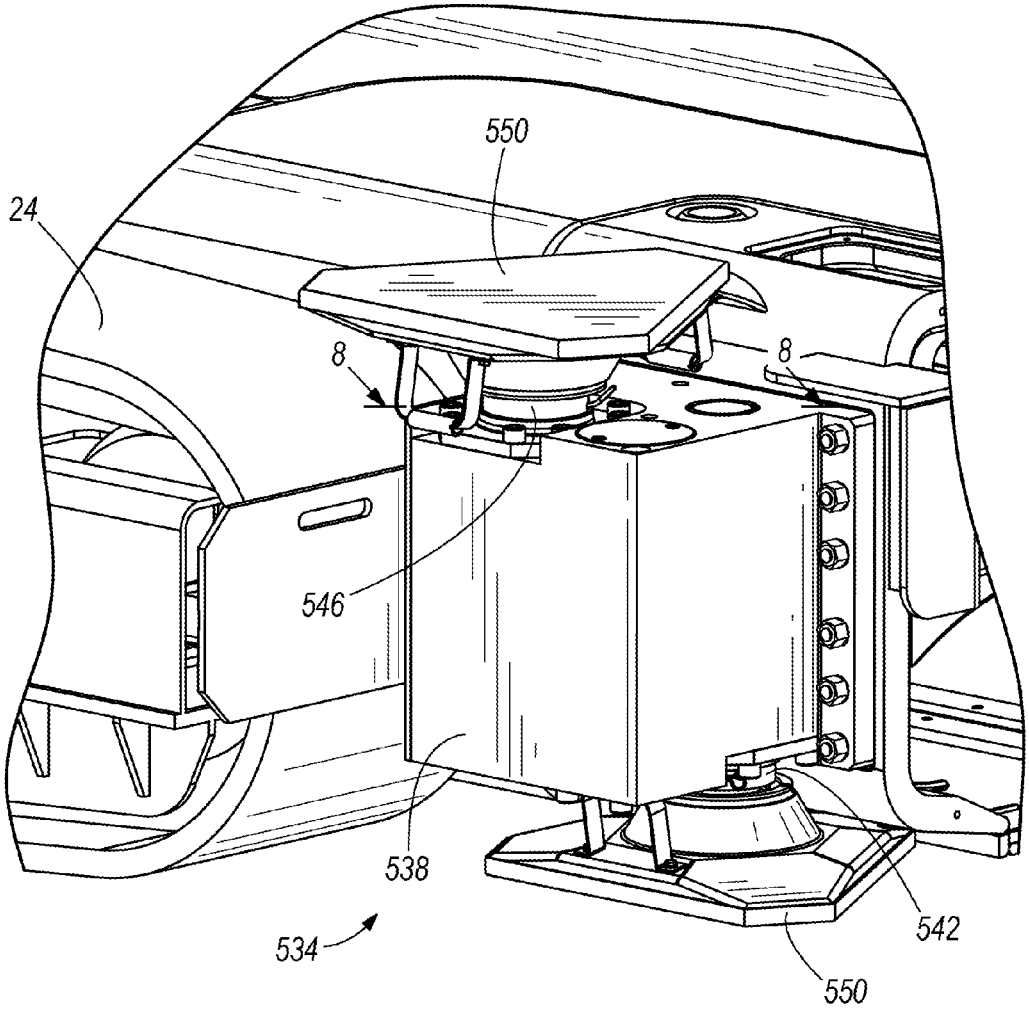
FIG. 6 is a perspective view of a stabilizer in a retracted state.
Figure 7:
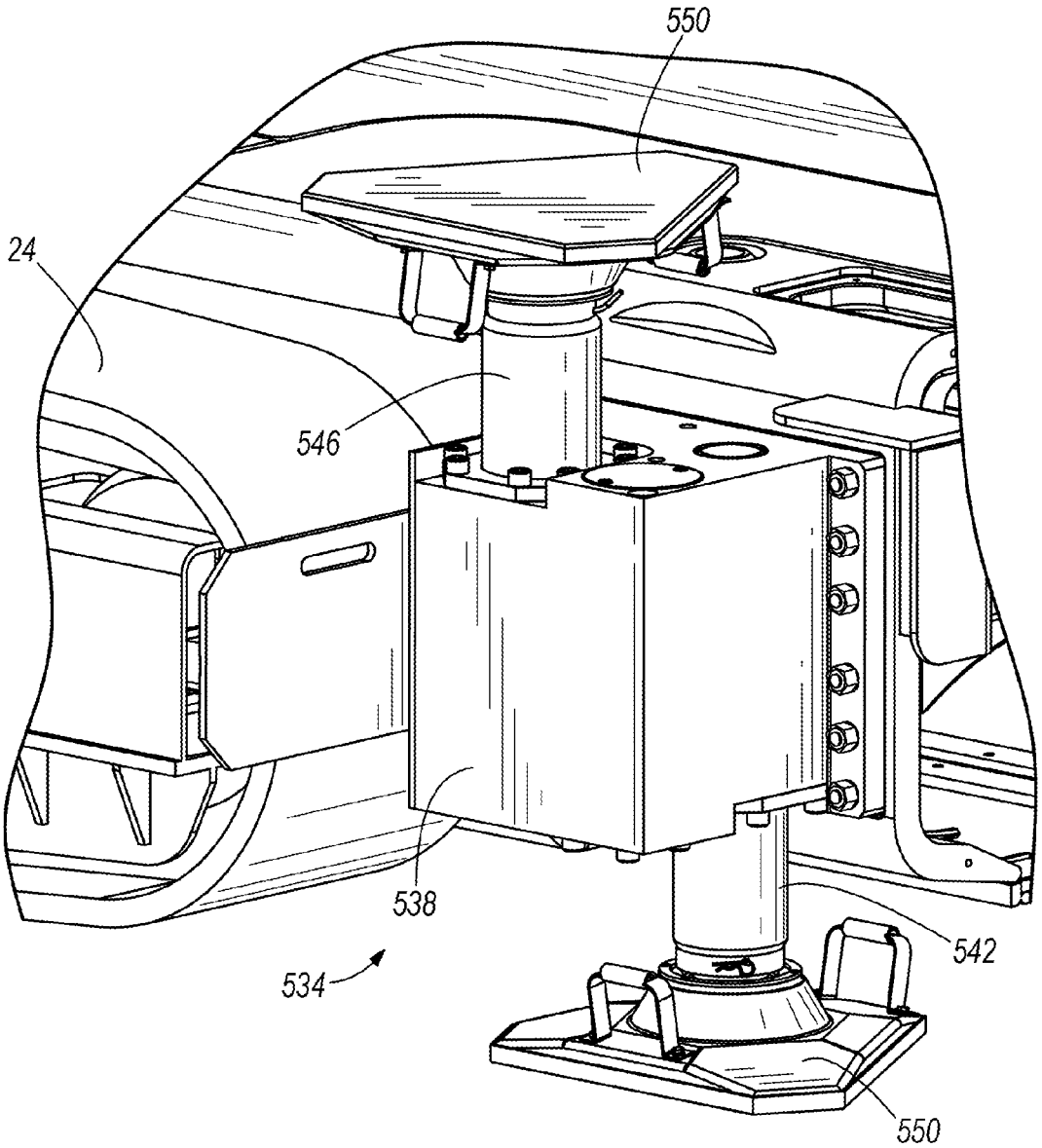
FIG. 7 is a perspective view of the stabilizer of FIG. 6 in an extended state.
Figure 8:
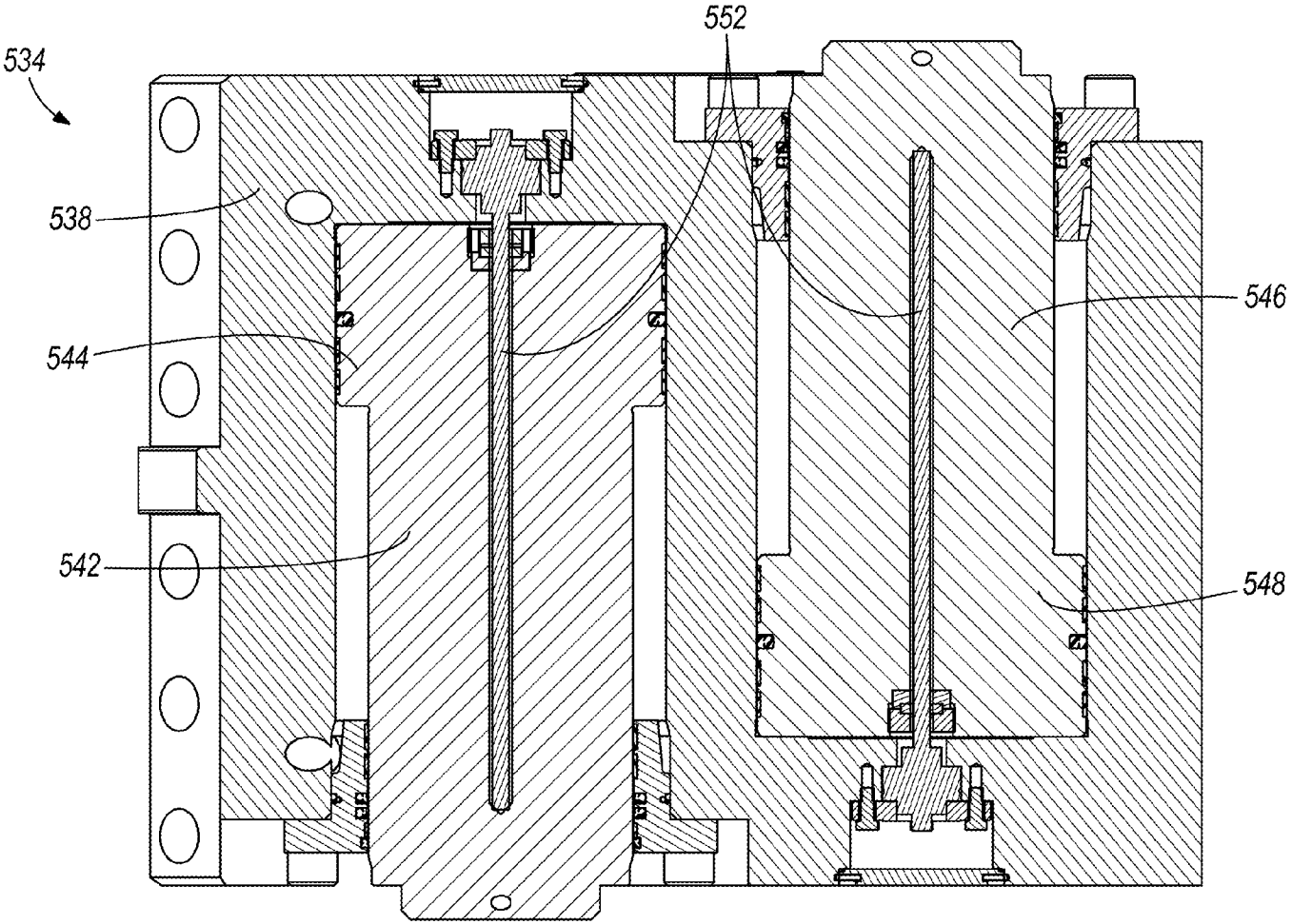
FIG. 8 is a cross-section view of the stabilizer of FIG. 6 taken along line 8-8.
Figure 12:
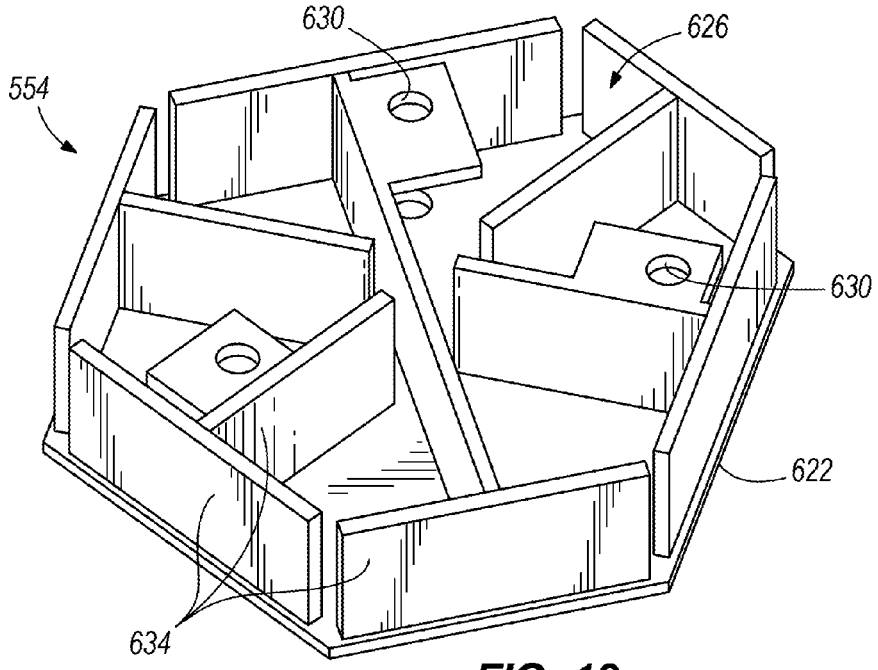
FIG. 12 is a perspective view of a spacer.
Figure 13:
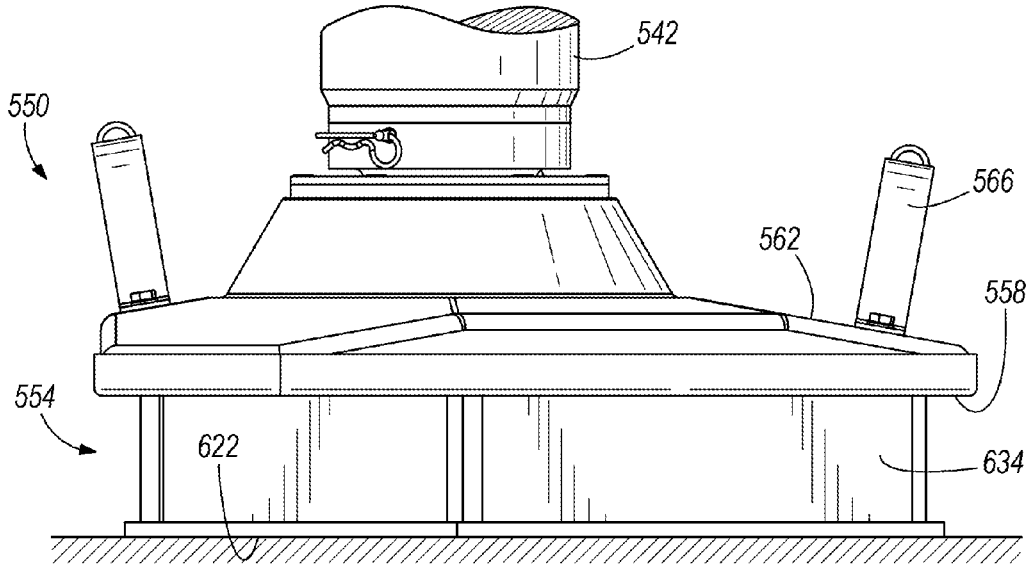
FIG. 13 is a side view of a headboard and spacer in a stacked configuration.

Referring to FIGS. 6 and 7, each stabilizer 534 includes a housing 538, a leveling actuator 542, a support actuator 546 independent of the leveling actuator 542, and a headboard 550 coupled to the end of each actuator 542, 546. As shown in FIG. 8, both the support actuator 546 and the leveling actuator 542 are mounted side-by-side within the housing 538. The actuators 542, 546 include a displacement transducer 552 (FIG. 8) to sense the position of each actuator 542, 546 within the housing 538. The leveling actuator 542 is used to level the machine 10, while the support actuator 546 is used in combination with the leveling actuator 542 to provide support and gripping force for the machine during the mining process. In the illustrated embodiment, the stabilizer 534 is strategically positioned relative to the machine to ensure maximum support and optimum leveling capabilities. In further embodiments (described below), each stabilizer 534 may also include one or more spacers 554 (FIGS. 12 and 13).

In the illustrated embodiment, the actuators 542, 546 are double-acting type hydraulic cylinders and hydraulic pressure is selectively applied to either side of a piston 544, 548 (FIG. 8) in order to extend or retract the cylinders. In other embodiments, the actuators 542, 546 can include another type of hydraulic actuator, a pneumatic actuator, an electric actuator (e.g., a switch or relay, a piezoelectric actuator, or a solenoid), a mechanical actuator (e.g., a screw or cam actuator), or another type of mechanism or system for moving a component of the mining machine.

Figure 9:
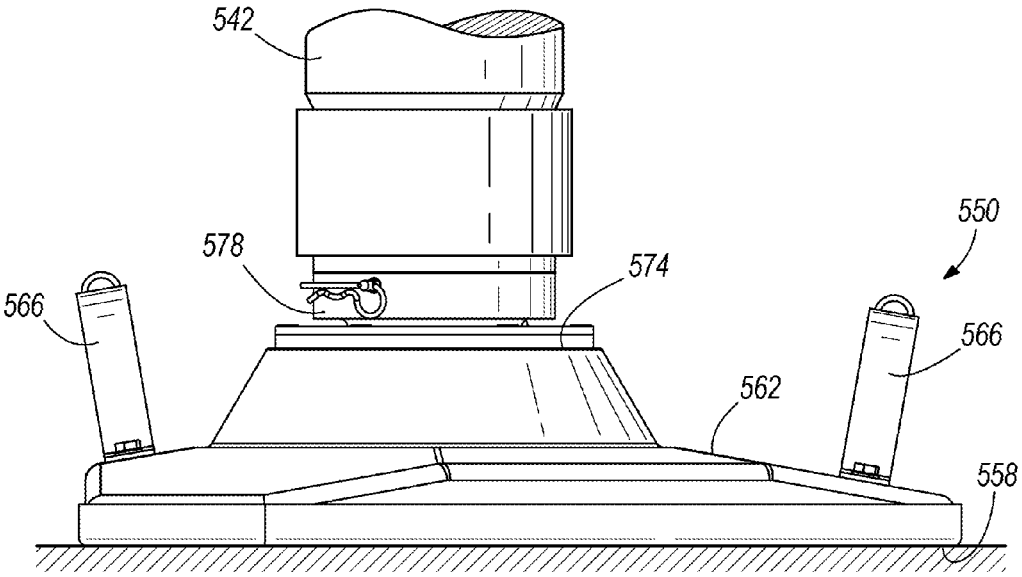
FIG. 9 is a side view of a headboard.
Figure 10:
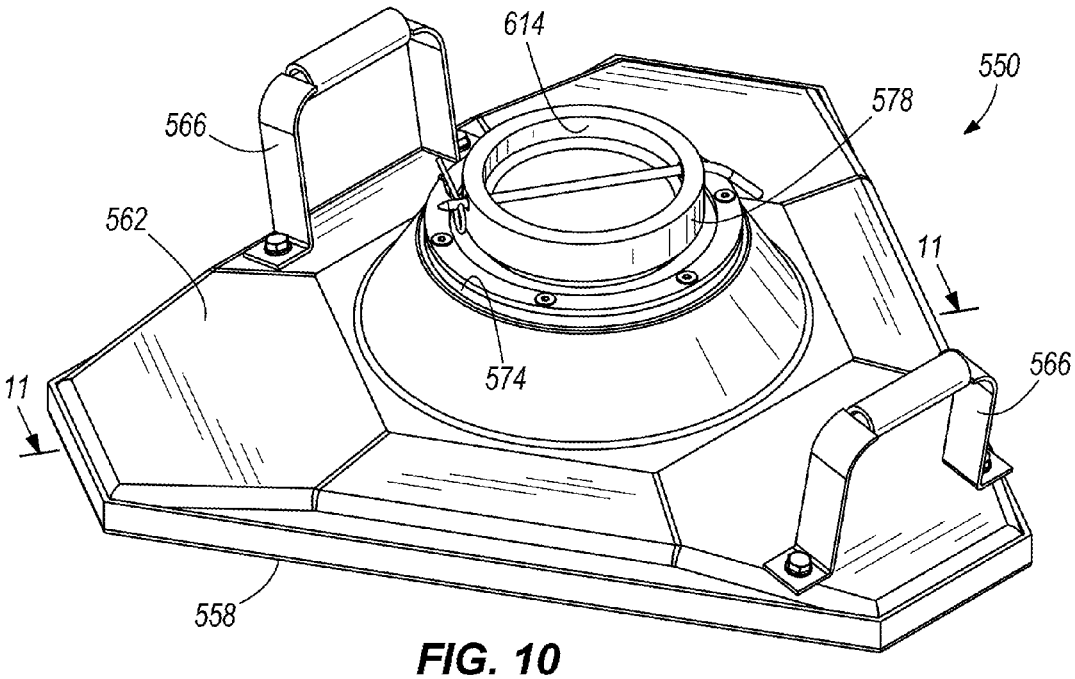
FIG. 10 is a perspective view of a headboard.
Figure 11:
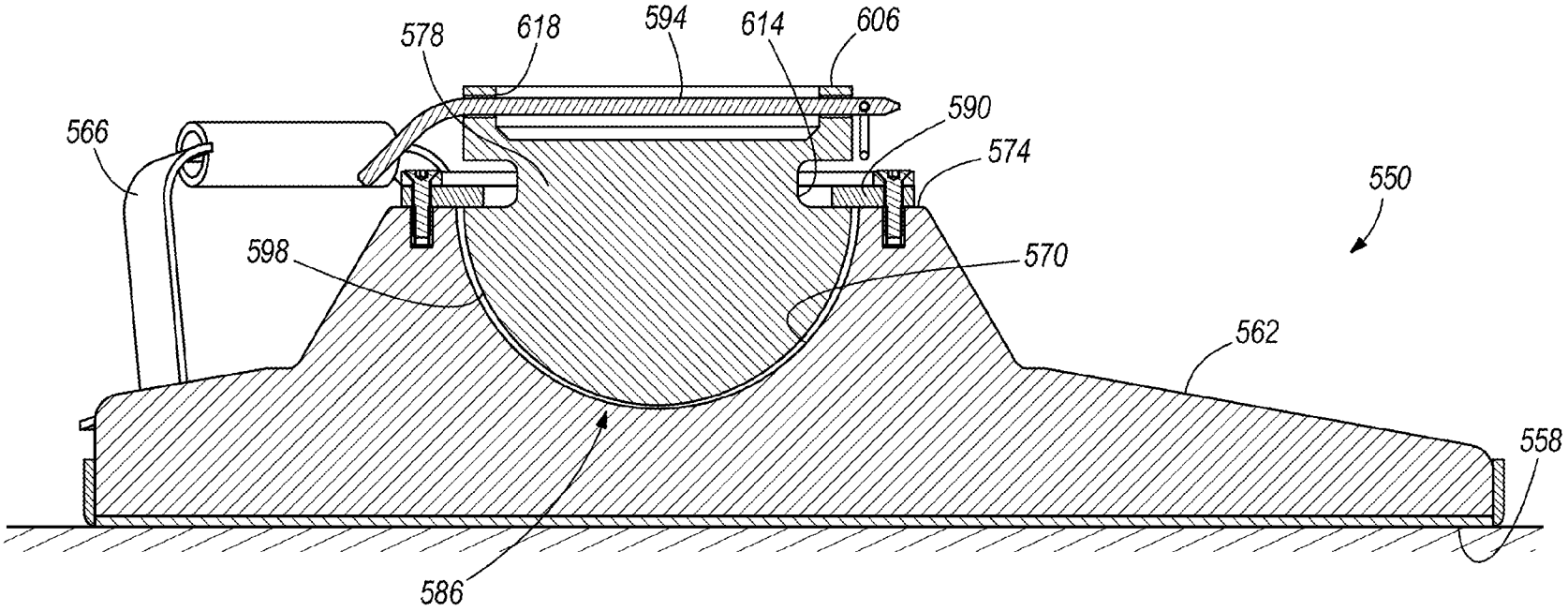
FIG. 11 is a cross-sectional view of the headboard of FIG. 10 taken along line 11-11.

As shown in FIGS. 9-11, the headboard 550 has a wide profile, or footprint, which provides a greater surface area of support. In the illustrated embodiment, the headboard 550 is generally triangular (with truncated corners). The headboard 550 includes a first side 558 for engaging the hanging wall (mine roof) or the footwall (mine floor), a second side 562 opposite the first side 558, a pair of handles 566 coupled to the second side 562, a socket 570 (FIG. 11) positioned on the second side 562, and a mounting surface 574 surrounding the socket 570. The handles 566 are provided to assist in handling and transporting the headboard 550 for installation on the stabilizer 534. In one embodiment, the headboard 550 is formed from a glass-reinforced plastic, and the first side 558 is bonded with a polyurethane friction material. The polyurethane material acts as a friction surface to protect the headboard 550 from damage.

Referring to FIGS. 9 and 11, the headboard 550 is coupled to each actuator 542, 546 (FIG. 9) by a joint assembly 578. In the illustrated embodiment, the joint assembly 578 is a ball-in-socket type coupling. As shown in FIG. 11, the joint assembly 578 includes a ball member 586, a flange 590 (which may be formed from polyurethane), and a locating pin 594. The ball member 586 includes a first end 598 having a round shape, a second end 606, and a groove 614 extending circumferentially around the ball member 586 between the first end 598 and the second end 606. The first end 598 fits within the headboard socket 570 to allow pivoting movement of the socket 570 about the ball member 586. The second end 606 has a cylindrical shape and includes a longitudinal bore 618 that fits over the actuators 542, 546.

The flange 590 of the joint assembly 578 is secured to the mounting surface 574 on the headboard 550 and is positioned within the groove 614 of the ball member 586. This arrangement allows the ball member 586 to pivot relative to the socket 570 to some degree, but the pivoting movement of ball member 586 is limited by the flange 590. The joint assembly 578 provides a self-aligning feature for the stabilizers 534, such that when the actuators 542, 546 are extended, the headboard 550 moves with respect to the ball joint 578 in order to lie flat against the roof or floor. In addition, when the actuators 542, 546 are retracted away from the floor or roof, the headboard 550 maintains its horizontal position. The bore 618 of the ball member 586 is slid over an end of one of the actuators 542, 546 and is secured by the locating pin 594. In this way, a headboard 550 is secured to each leveling actuator 542 and support actuator 546.

The headboard 550 enhances the efficiency of the stabilizers 534. The headboard 550 may be made of composite material rather than steel to provide reduced weight and improved handling. The headboard 550 sustains a larger load and provides coverage over a larger area than previous designs. The headboard 550 is durable and can deform elastically, which aids in withstanding shocks caused by blasting. The composite material for the headboard 550 is unreactive and corrosion-resistant. These factors give the composite headboard 550 a longer life, reducing the overall cost of the stabilizers 534. In addition, the headboard 550 exerts a stabilizing force against the footwall as well as the roof. The headboard 550 can accommodate uneven mine roof and floor conditions through the adaptive joint assembly 578.

As shown in FIG. 12, each spacer 554 includes a first side 622 and a web 626 opposite the first side 622, and locating holes 630 positioned within the web 626. The first side 622 is adapted to engage the mine roof or floor. The web 626 includes multiple plates 634 to support the necessary load. As shown in FIG. 13, the spacer 554 can be positioned between the headboard 550 and the mine roof or floor. In further embodiments, the spacer 554 may be coupled directly to one of the actuators 542, 546 by a joint assembly similar to the joint assembly 578, and the headboard 550 is then positioned between the spacer 554 and the mine floor or roof.

Multiple spacers 554 may be stacked on the first side 558 of the headboard 550 to support the mine roof or floor. The locating holes 630 for each spacer 554 are aligned and a pin (not shown) is placed within the hole 630 to insure the spacers 554 remain aligned with one another in a column and do not slip. In other embodiments, the spacer 554 may not include any locating holes. In one embodiment, the spacers 554 are formed from steel and are coated with a material having a high coefficient of friction. The spacers 554 support a large load in compression and have a reduced mass for a consistent strength-to-weight ratio. The mass reduction provides easier handling and transportation.

In another embodiment (not shown), the stabilizers 534 include side actuators oriented in a horizontal direction to support the side walls of the mine. The stabilizers in this case would include features similar to the stabilizers 534 described above, including the headboard 550 and the joint assembly 578.

Figure 14:
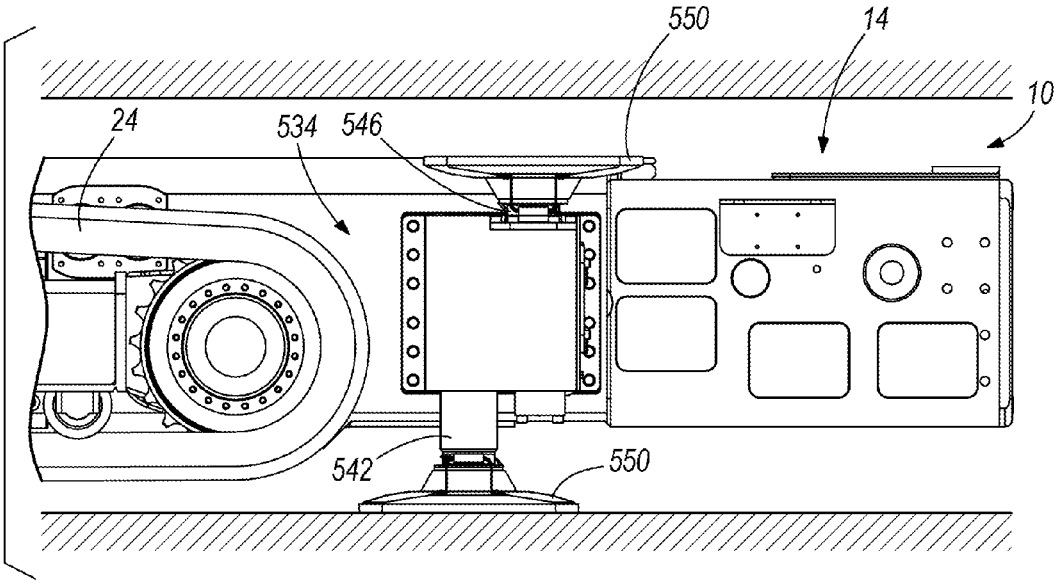
FIG. 14 is a partial side view of the mining machine of FIG. 1 with a leveling actuator in an extended state.
Figure 15:
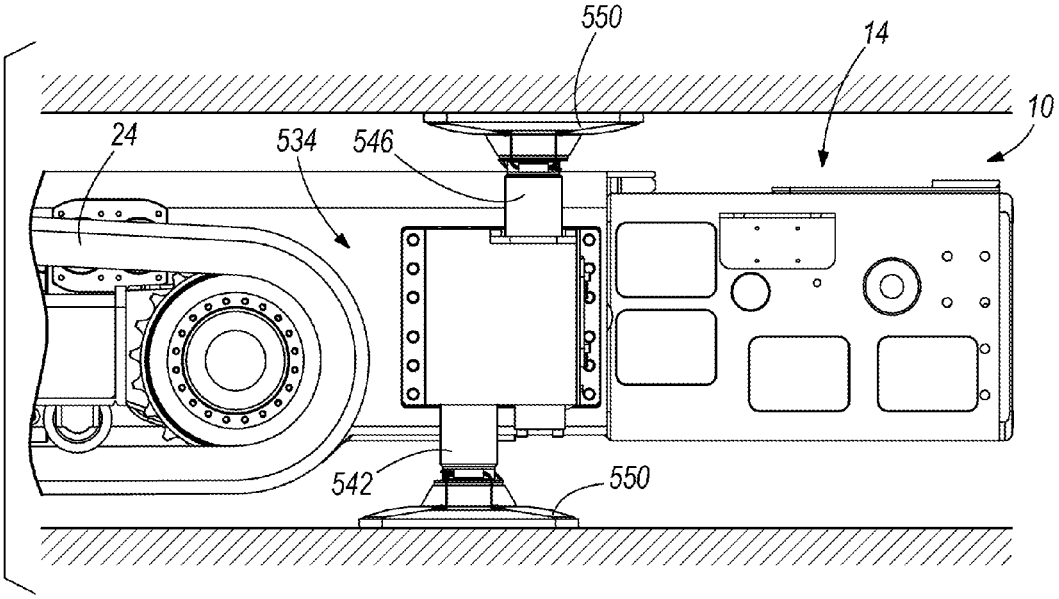
FIG. 15 is a partial side view of the mining machine of FIG. 1 with a leveling actuator and a support actuator in extended states.
Figure 16:
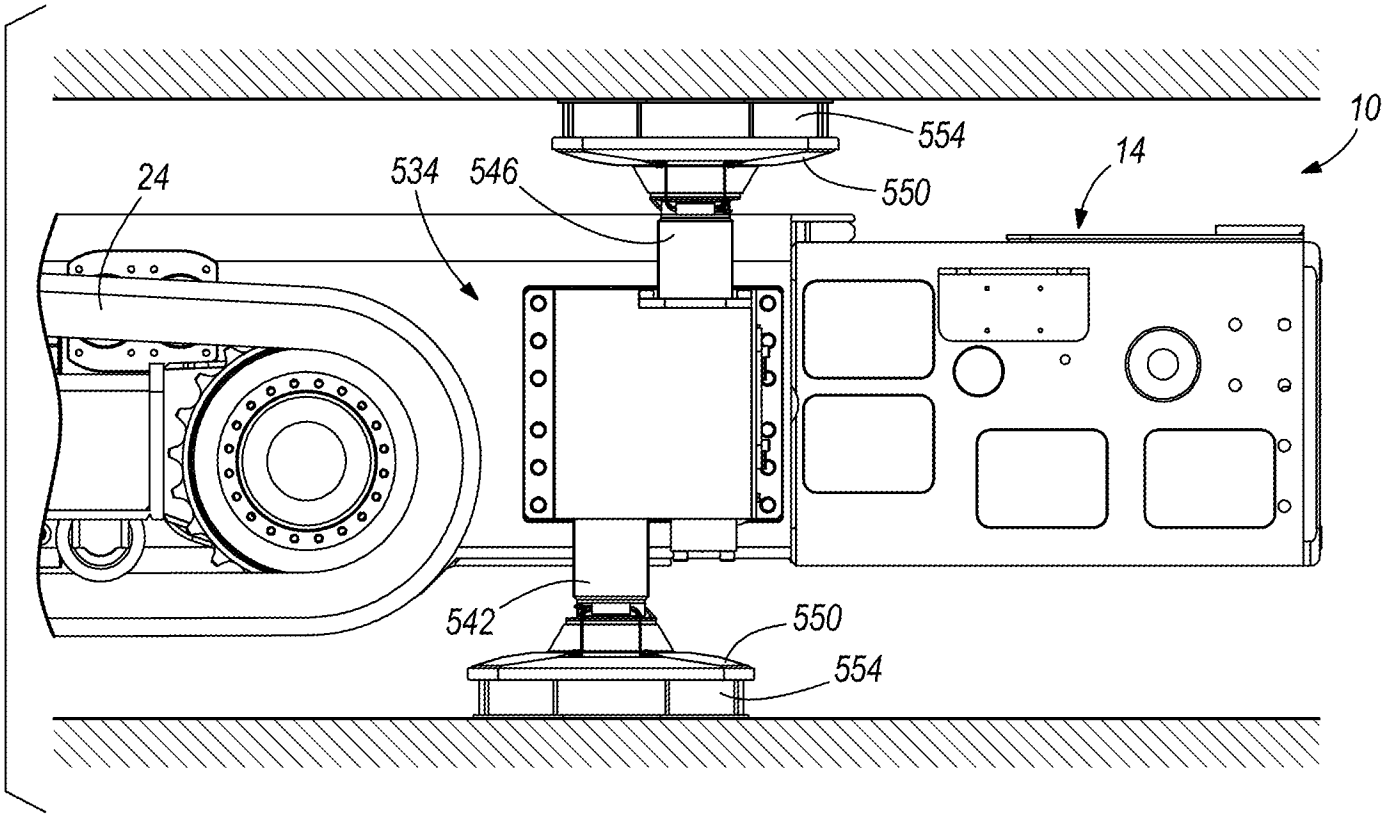
FIG. 16 is a partial side view of the mining machine of FIG. 1 with a leveling actuator and a support actuator in extended states and further including a spacer positioned adjacent a headboard coupled to each actuator.

As shown in FIGS. 14-16, the stabilizers 534 perform both the leveling and stabilization functions for the continuous mining machine 10. First, as the mining machine 10 is positioned near the wall to be mined, both the support actuators 546 and the leveling actuators 542 are retracted (FIG. 6). The leveling actuators 542 are then extended (FIG. 14) in order to orient the machine 10 at an angle suitable to complete the mining operation. The headboards 550 of the leveling actuators 542 engage the mine floor. Then, to insure that the continuous mining machine 10 is stabilized during the cutting operation, the support actuators 546 are extended such that the headboards 550 engage the mine roof (FIG. 15). In addition, as shown in FIG. 16, one or more spacers 554 may be positioned between each headboard 550 and the mine roof and mine floor.

Figure 17:
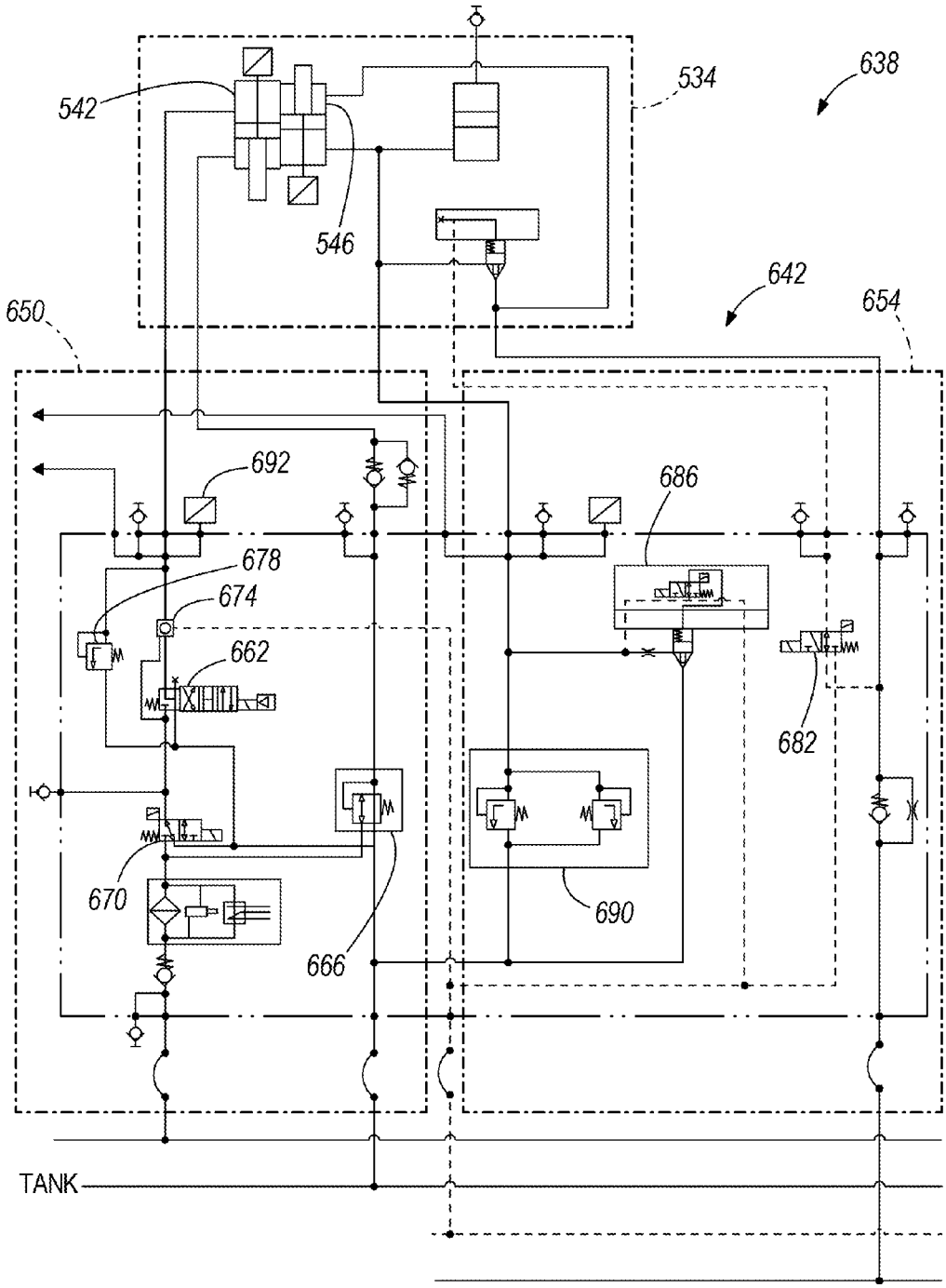
FIG. 17 is a schematic diagram of a hydraulic control system for a stabilizer.

The stabilizers 534 are controlled via a control system 638, and a representative control system 638 is shown in FIG. 17. Although the control system 638 is described below with respect to a hydraulic system, a similar control system may be applied using any of several different types of power systems.

In some embodiments, the control system 638 indirectly measures the physical force between the actuators 542, 546 and the mine surface. In particular, parameters of the actuators 542, 546 can provide one or more indicators of the physical force between the actuators 542, 546 and the mine surface. The control system 638 can determine if these indicators equal or exceed a predetermined value to indirectly determine if the physical force between the actuators 542, 546 and the mine surface has reached the predetermined threshold. For example, if the actuators 542, 546 include hydraulic cylinders, the control system 638 can use a pressure value of the actuators 542, 546 as an indicator of the physical force applied between the actuators 542, 546 and the mine surface. In particular, the control system 638 can extend the actuators 542, 546 toward the mine surface until the actuators 542, 546 are pressurized to a predetermined pressure value. The control system 638 can use a similar pressure value as an indicator of the physical force between the actuators 542, 546 and the mine surface when the actuators 542, 546 include pneumatic actuators. In other embodiments, the control system 638 can use parameters of a current supplied to the actuators 542 and 546, a force value between components of the actuators 542 and 546, or a physical position of a component of the actuators 542 and 546 as the indicator of the physical force between the actuators 542, 546 and the mine surface. Other components of the machine 10, such as displacement transducers or an inclinometer, can also provide one or more feedback indicators of the physical force between the actuators 542, 546 and the mine surface.

In the illustrated embodiment, the control system 638 includes a control manifold 642 mounted separately from the stabilizer housing 538, displacement transducers 552 (FIG. 8), pressure transducers 692 (shown schematically in FIG. 17), an inclinometer (not shown), and a programmable logic controller ("PLC"; not shown). The displacement transducers 552 and pressure transducers 692 are mounted on the actuators 542, 546 and measure the actuator position and pressure, respectively, to provide feedback to the control system 638 regarding the force between the actuators 542, 546 and the mine surface. The inclinometer measures the inclination of the machine 10 in both longitudinal and lateral directions. In other embodiments, other sensors may be used to measure an indicator of the physical force between the actuators 542, 546 and the mine surface.

As shown in FIG. 17, the control manifold 642 includes a leveling system 650 and a support system 654. The leveling system 650 includes a high-response servo solenoid valve or proportional valve 662 having onboard control electronics and a fail safe position, a pressure-reducing valve 666, a two-position directional control valve 670, a pilot-operated check valve 674, and a pressure relief valve 678. These components are associated with the leveling actuators 542. The support system 654 includes a first permissive valve 682 for extending the support actuator 546, a second permissive valve 686 for retracting the support actuator 546, and pilot-operated check valves 690. These components are associated with each support actuator 546. The permissive valves 682 and 686 are two-position directional control valves. The support system 654 will be discussed in detail after describing the leveling system 646.

The proportional valve 662 controls the direction and magnitude of oil flow into each actuator 542 by permitting precise control of oil into a full-bore side of the leveling actuators 542. The pressure reducing valve 666 maintains a permanent connection between a rod side of the leveling actuators 542 and the main pressure supply. The pressure reducing valve 666 sets the balance pressure, which is used to retract the leveling actuators 542 and lower the mining machine 10 onto its tracks 24 when required. In one embodiment, the balance pressure is approximately 20 bar. Although the weight of the machine 10 is sufficient to lower the machine 10 when the proportional valve 662 bleeds off a precise amount of oil, the leveling actuator 542 is lifted off the floor to a retracted position before the machine 10 can tram to perform the mining operation.

When a desired machine position is reached, the leveling actuator 542 is locked in position by the pilot-operated check valve 674. The two-position, three-way directional control valve 670 controls the oil flow to the proportional valve 662 and also supplies the pilot pressure to the pilot-operated check valve 674. The directional control valve 670 is energized when any adjustment is required and is de-energized as soon as the desired position is reached. The direct-operated pressure relief valve 678 limits the downward pushing force (i.e., the lifting force) of each actuator 542. The pressure relief valve 678 is set to an optimal pressure value to limit any pressure peaks which may occur during normal or abnormal operations.

The four leveling actuators 542 are capable of being controlled either individually or as a group via a remote control. For instance, to move a single leveling actuator 542, the operator can select the respective actuator 542 on the remote control and actuate a joystick in the desired direction of movement (i.e., up or down).

Figure 18:
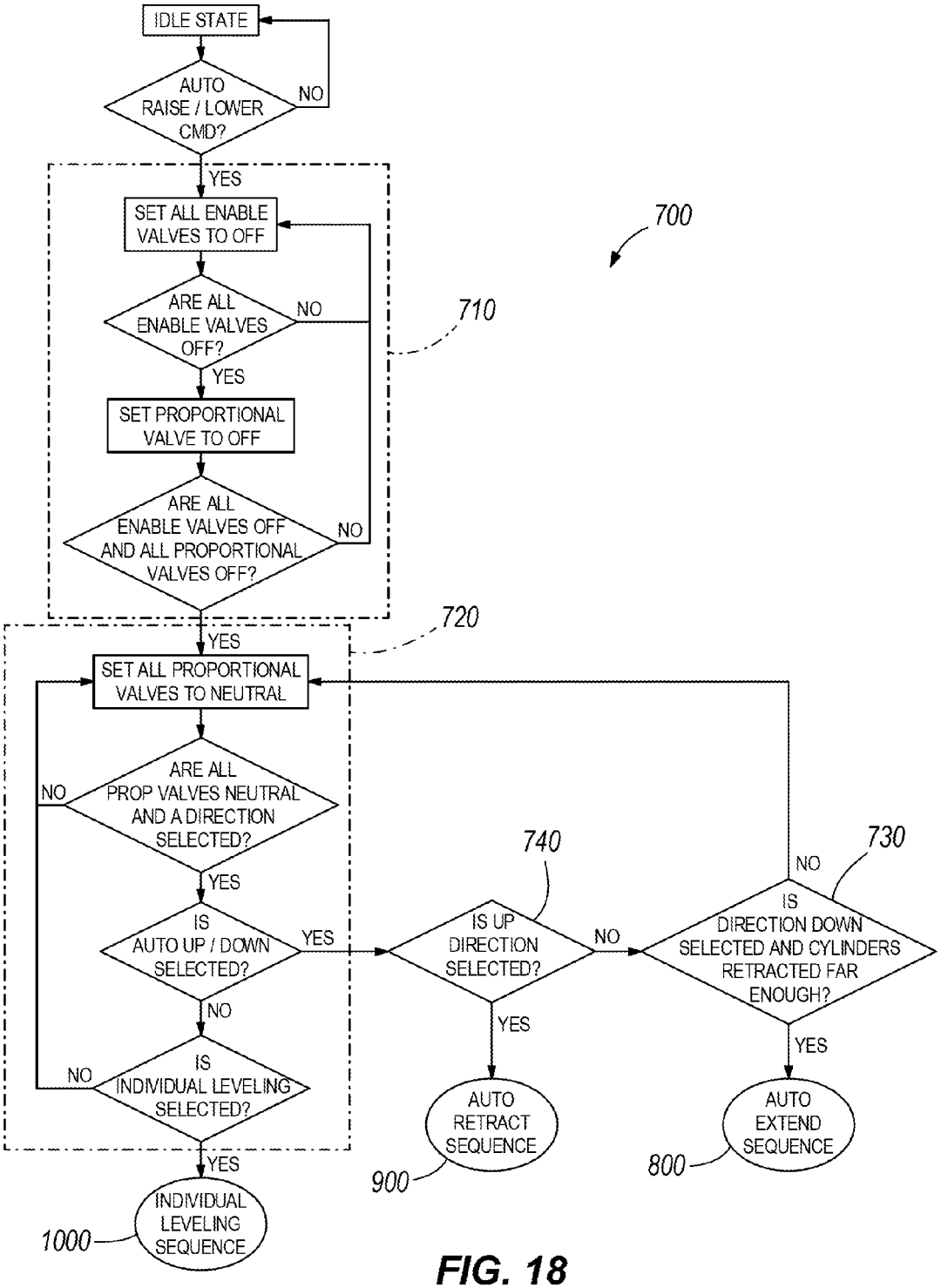
FIG. 18 is a schematic diagram of a leveling selection sequence.
Figure 19:
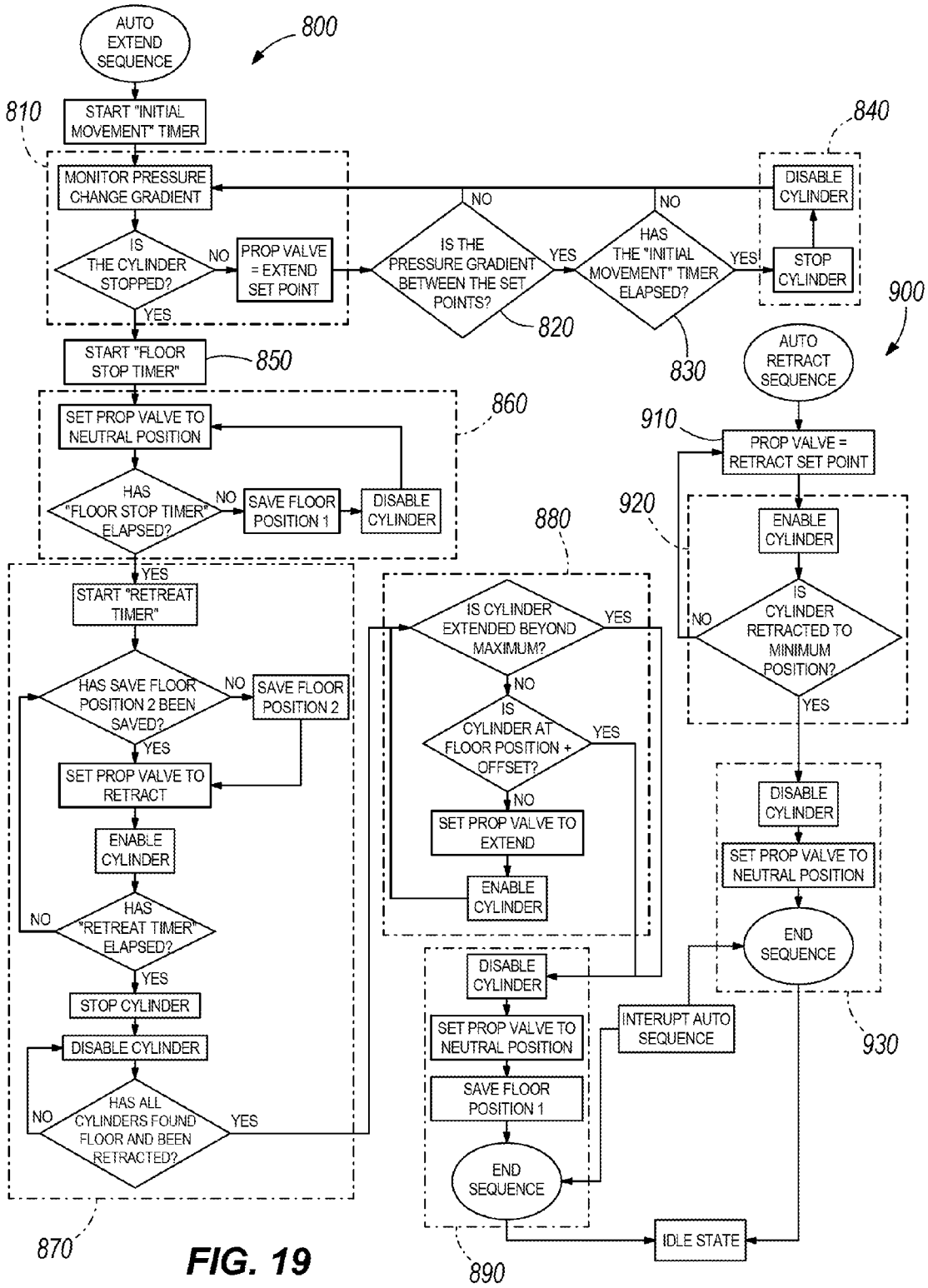
FIG. 19 is a schematic diagram of a leveling control sequence for automatic extension and retraction of the stabilizers.
Figure 20:
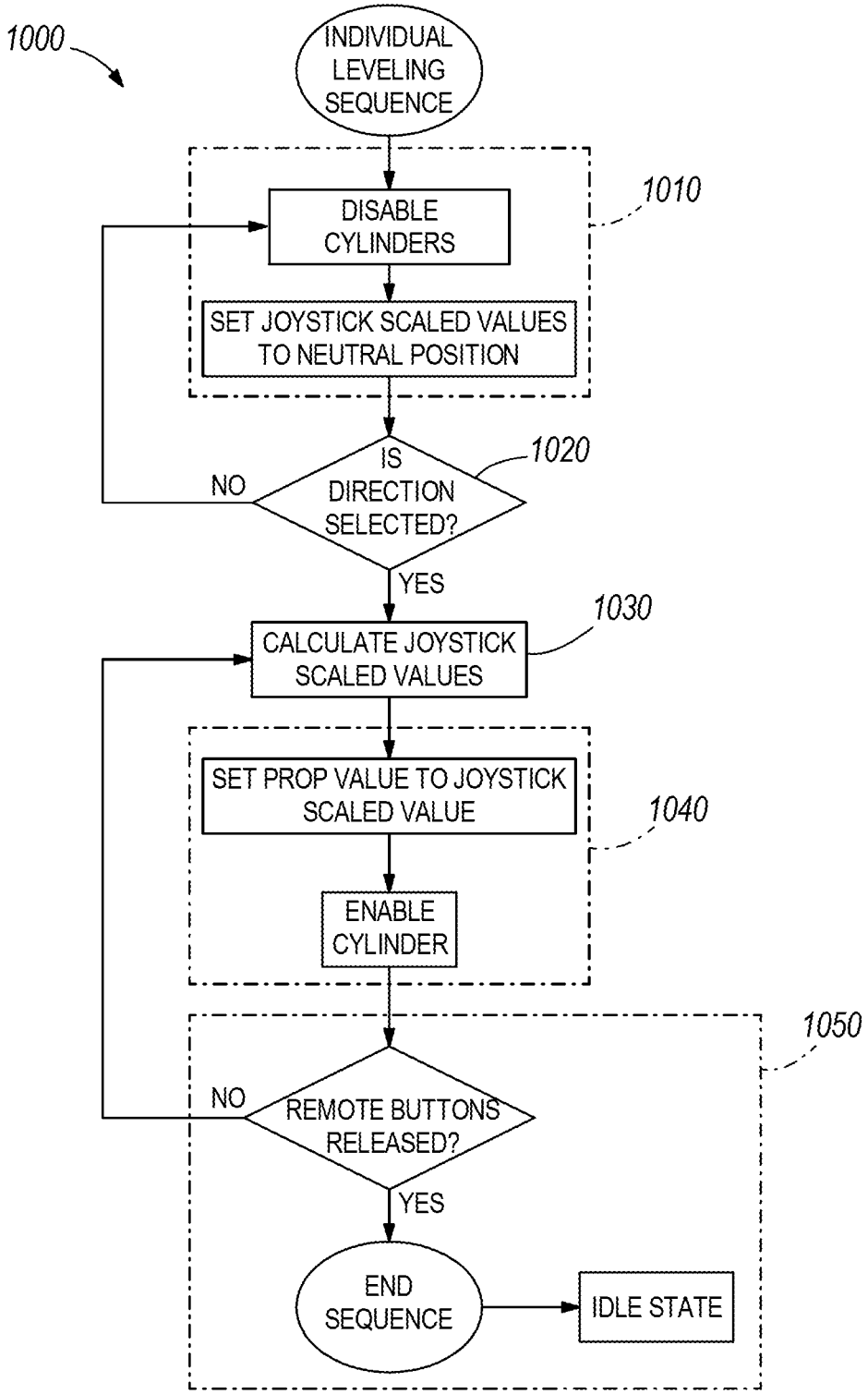
FIG. 20 is a schematic diagram of a leveling control sequence for manual leveling of the stabilizers.

The continuous mining machine 10 includes a logic controller (not shown) to control leveling of the machine 10. As shown in FIG. 18, the logic controller includes a leveling selection sequence 700 to select between multiple leveling sequences for the leveling actuators 542. In the illustrated embodiment, a logic controller includes an automatic extend sequence 800 (FIG. 19), automatic retract sequence 900 (FIG. 19), and an individual leveling sequence 1000 (FIG. 20).

Referring to FIG. 18, the leveling selection sequence 700 includes the first step 710 of placing all proportional valves 662 and directional control valves 670 in the off position. The next step 720 is to place the proportional valves 662 in a neutral position, select either individual or automatic leveling, and select a direction for movement of the leveling actuators 542. If an automatic DOWN direction is selected (step 730), the controller initiates the automatic extend sequence 800 (FIG. 19). If an automatic UP direction is selected (step 740), the controller initiates the automatic retract sequence 900 (FIG. 19). If any of the actuator buttons indicating individual leveling is selected then the controller initiates the individual leveling sequence 1000 if appropriate (FIG. 20). In this way, leveling of the mining machine 10 is done automatically by the control system 638 in response to a controller command. In one embodiment, the operator presses a combination of buttons on a remote control together with moving the joystick in the desired direction (up or down) to initiate a command sequence to support or un-support the machine 10.

When the automatic extend sequence 800 is entered, the leveling actuators 542 are actuated downwards until the indicator of the physical force between the actuators 542 and the mine surface reaches a predetermined value. Referring to FIG. 19, the automatic extend sequence 800 first sets the proportional valves 662 to actuate the leveling actuators 542 (step 810). Each leveling actuator 542 extends at a preset speed, and the system determines when each respective headboard 550 engages the mine floor by detecting when the indicator reaches a predetermined value or falls within a specified range of values (step 820). In the illustrated embodiment, the indicator is the pressure gradient within the leveling actuator 542. The pressure is monitored using, for instance, a discrete first derivative of pressure measurements from a pressure transducer 692 for each leveling actuator 542. Initial movement is ignored for a programmable period of time (step 830), since the pressure curve during the initial movement each actuator 542 is similar to the pressure curve exhibited when the headboard 550 engages the floor.

Once the leveling actuators 542 reach the mine floor, the leveling actuators 542 are stopped (step 840) and a delay timer starts to allow for the accurate measurement of the displacement of actuator 542 (step 850). If the pre-determined value of the indicator is reached outside the bounds of the maximum extension length or the maximum extension time, then the automatic extend sequence 800 is aborted. If one or more leveling actuators 542 fails to find the floor within a specified time, then extension of all stabilizers 534 is stopped and the automatic extend sequence 800 is aborted. In either case (i.e., whether all stabilizers 534 touch the floor or if any leveling actuator 542 fails), the operator receives an indication from, for instance, an indicator light or from the remote control. If a leveling actuator 542 fails to touch the floor, the operator may individually control the respective actuator 542.

Once all leveling actuators 542 engage the floor, the operator is able to adjust individual leveling actuators 542 from the remote control. If any leveling actuator 542 is adjusted manually, the control system 638 deems the machine 10 not level. The operator can input a command sequence via a remote to instruct the control system that the machine has been leveled manually and is ready to commence with normal operations.

Two parameters affect the sensitivity of the control system 638 to finding the floor: 1) the range of the indicator of physical force between the actuators 542 and the mine surface (i.e., the pressure gradient in the illustrated embodiment) and 2) the amount of time during which the indicator is within the specified range. The control system 638 determines whether the floor has been found by each leveling actuator 542 by measuring the displacement of the actuators 542 and detecting whether both of the parameters are satisfied. The displacement can be calculated by measuring the amount of time required for the actuator 542 to extend to a point at which the indicator of physical force reaches a predetermined value. The position at which the actuator engages the mine surface is determined by measuring either a parameter related to the elapsed time or the extension length of the actuator. After a leveling actuator 542 finds the floor, each actuator 542 is retracted a few millimeters so that the force applied by the individual actuator 542 does not affect readings for the other leveling actuators 542.

Once each of the four leveling actuators 542 have found and stored the floor position in a memory of the PLC (not shown) of the control system 638, the actuators 542 remain stationary for a predetermined period of time (step 860) at the "floor found" position. The leveling actuators 542 then retract for a predetermined period of time and then stopped (step 870). Next, the leveling actuators 542 are extended until each actuator 542 reaches the "floor found" position plus a desired offset distance (step 880). If the leveling actuator 542 extends beyond a maximum extension range, the automatic extend sequence 800 is aborted. Once the desired position is reached, the proportional valve 662 is set to a neutral position to stop the leveling actuators 542 (step 890).

The automatic retract sequence 900 is used to un-level the mining machine 10 (i.e., to put the machine 10 back on tracks 24). As shown in FIG. 19, the automatic retract sequence includes the first step 910 of actuating the proportional valve 662 to a retract set point. This enables the leveling actuators 542 to retract upwards simultaneously (step 920). Once all of the leveling actuators 542 are in the minimum position, the sequence ends (step 930).

The leveling actuators 542 may be lowered individually to prevent the center of gravity of the mining machine 10 from shifting. Referring to FIG. 20, the individual leveling sequence 1000 includes the first step 1010 of disabling all leveling actuators 542 and setting scaled joystick values to neutral. The next step 1020 is to select a direction for the leveling actuators 542 to move. Then, the scaled joystick value is calculated for the selected direction (step 1030). The proportional valve 662 is then set to a scaled joystick value and the individual leveling actuator 542 is actuated (step 1040). Once the leveling actuator 542 is leveled, the actuator 542 is stopped (step 1050). This process is repeated until all of the leveling actuators 542 are leveled.

After the mining machine 10 is leveled, support actuators 546 are activated to engage the roof and ensure that the machine 10 is adequately anchored during the cutting operation. In one embodiment, the control system 638 is interlocked to allow support actuators 546 to engage the roof after a leveling sequence is completed and not vice versa, in order to prevent damage to the tracks 24.

Figure 21:
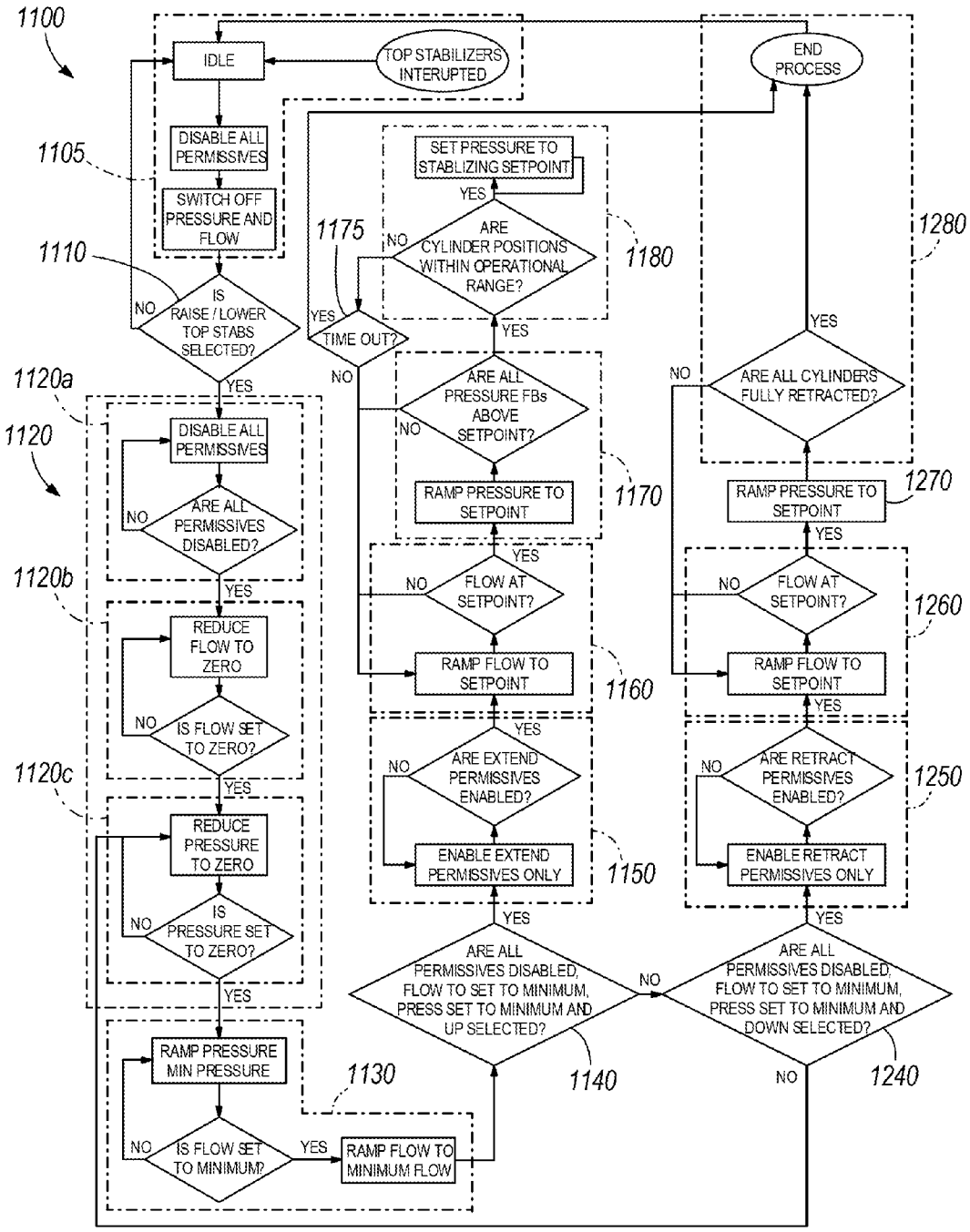
FIG. 21 is a schematic diagram of a stabilizing control sequence.

As shown in FIG. 21, the controller includes an automatic stabilization sequence 1100 for stabilizing the support actuators 546 against the hanging wall or roof. From an idle state (step 1105), the stabilization sequence is initiated (step 1110) and the controller disables the first permissive valve 682 and the second permissive valve 686 for each support actuator 546 (step 1120*a*). In the illustrated embodiment, the controller reduces fluid flow to zero (step 1120*b*) and reduces pressure to zero (step 1120*c*). The controller then ramps, or gradually increases, the pressure to a minimum pressure level and ramps the flow to a minimum flow level (step 1130). Next, the controller determines whether the "raise" sequence is selected (step 1140). As described above, the operator can actuate the support actuators 546 by, for instance, pressing a combination of buttons on the remote control together with moving the joystick in a desired direction (i.e., up or down). All support actuators 546 are activated simultaneously during the stabilization sequence 1100.

If the raise sequence is selected, the controller activates the first permissive valves 682 (step 1150) to maintain a set extension speed. In the illustrated embodiment, the controller also unlocks the pilot-operated check valves 690, thereby allowing the flow to ramp to a predetermined value or set point (step 1160) and the pressure to ramp to a predetermined value or set point (step 1170).

In the illustrated embodiment, the pressures in the support actuators 546 are monitored as the support actuators 546 extend. The control system 638 determines that the headboard 550 has engaged the roof when at least one indicator of the force between the actuator 546 and the roof reaches a predetermined value. This indicator may include, for example, the pressure in the actuator 546. The control system 638 compares the measured extension time and extension length of the actuator 546 against a maximum permitted extension time and extension length, respectively. That is, if the stabilizer pressure does not increase to the preset pressure value within a pre-determined actuator extension range and within a preset time, the operation times out (step 1175). This causes all of the stabilizers 534 to stop and the auto stabilization sequence 1100 is aborted.

In the illustrated embodiment, when all of the headboards 550 touch the roof, the controller checks whether the positions of the support actuators 546 are within an operational range. If so, the indicator increases until a predetermined value is reached (step 1180). In the illustrated embodiment, extra pressure is applied until a pre-determined pressure set point is reached. The pressure set point is maintained mechanically, independent of the control system 638. During an "auto-cut" or "find face" control sequence of operation of the machine, the actuator indicators (i.e., the pressures and positions in the illustrated embodiment) are monitored. If the indicator of force between the actuator 546 and the roof falls below the predetermined value, then the mining machine 510 is deemed unsupported and all command sequences are aborted. When all support actuators 546 are engaging the roof, the stabilizers 534 are automatically re-energized until the indicator of force for each actuator reaches the predetermined value. When the predetermined value is achieved in all support actuators 546, the operator receives an indication from, for instance, an indicator light or from the remote control. At this point, other machine operations (such as, for example, a "find face" or automatic cutting sequence) can be performed. Since the full force of the actuators 546 is not applied until all support actuators 546 are in place, the force is evenly distributed on the roof.

If the "raise" sequence is not selected, the controller determines if the "lower" sequence is selected (step 1240). The "lower" sequence may be selected by actuating the remote control (including, for instance, moving the joystick downward in combination with pressing other remote control buttons) to retract the support actuators 546. If the "lower" sequence is selected, the controller activates the second permissive valves 686 (step 1250) to maintain a set retraction speed. The controller also unlocks the check valves 690. In the illustrated embodiment, this permits the controller to ramp the flow to a predetermined value or set point (step 1260), and then ramp the pressure to a predetermined value or set point (step 1270). The support actuators 546 then retract until they have retracted a predetermined distance (step 1280).

Thus, the invention provides, among other things, a stabilization system for a mining machine. Although the invention has been described in detail with reference to certain preferred embodiments, variations and modifications exist within the scope and spirit of one or more independent aspects of the invention as described. Various independent features and independent advantages of the invention are set forth in the following claims.

The invention claimed is:

1. A method for stabilizing a mining machine relative to a mine surface, the method comprising:

extending at least one actuator toward a mine surface until at least one indicator of the force between the actuator and the mine surface reaches a predetermined value;

retracting the at least one actuator for a predetermined amount of time; and extending the at least one actuator for the predetermined amount of time plus an additional amount of time.

2. The method of claim 1, further comprising saving an extension time required for the at least one actuator to extend to a point at which the at least one indicator of the force between the actuator and mine surface reaches the predetermined value.

3. The method of claim 2, further comprising comparing the saved extension time with a maximum permitted extension time; and aborting the method for leveling the mining machine if the saved extension time is greater than a maximum permitted extension time.

4. The method of claim 1, wherein extending the at least one actuator includes extending the actuator at a predetermined speed.

5. The method of claim 1, further comprising saving an extension length required for the at least one actuator to extend to a point at which at least one indicator of the force between the actuator and the mine surface reaches the predetermined value.

6. The method of claim 5, further comprising comparing the saved extension length of the at least one actuator with a maximum permitted extension length, and aborting the method for leveling the mining machine if the saved extension length is greater than a maximum permitted extension length.

7. The method of claim 1, wherein extending at least one actuator toward a mine surface includes extending a hydraulic cylinder toward the mine surface until a pressure within the cylinder reaches a predetermined value.

8. The method of claim 1, further comprising, after extending the at least one actuator toward a mine surface, maintaining multiple actuators at a position at which at least one indicator of the force between each actuator and the mine surface is at the predetermined value, wherein retracting the at least one actuator includes simultaneously retracting multiple actuators for a predetermined amount of time, and wherein extending the at least one actuator for the predetermined amount of time includes simultaneously extending multiple actuators for the predetermined amount of time plus the additional amount of time.

* * * * *